US005221133A

United States Patent [19]

Braun et al.

[11] Patent Number: 5,221,133

[45] Date of Patent: Jun. 22, 1993

[54] SUPPORTING DISK

[75] Inventors: Otmar Braun, Frielendorf; Herbert Schumacher, Gorxheimer Tal, both of Fed. Rep. of Germany

[73] Assignee: Firma Carl Freudenberg, Weinheim/Bergstr., Fed. Rep. of Germany

[21] Appl. No.: 957,967

[22] Filed: Oct. 7, 1992

[30] Foreign Application Priority Data

Nov. 8, 1991 [DE] Fed. Rep. of Germany ..... 4136794

[51] Int. Cl.[5] ..... D01H 1/24; F16C 13/00

[52] U.S. Cl. ..... 384/549; 57/103; 57/406

[58] Field of Search ..... 384/549, 295, 58; 57/103, 406

[56] References Cited

U.S. PATENT DOCUMENTS

| | | | |
|---|---|---|---|
| 3,964,324 | 6/1976 | Gassner et al. | 57/103 X |
| 4,020,710 | 5/1977 | Gassner et al. | 57/103 X |
| 4,676,673 | 6/1987 | Stahlecker et al. | 57/103 X |
| 4,713,932 | 12/1987 | Zott | 57/406 |
| 4,892,422 | 1/1990 | Stahlecker | 384/549 |
| 4,893,946 | 1/1990 | Tesh et al. | 384/549 |
| 4,893,947 | 1/1990 | Hurley | 384/549 |
| 4,896,976 | 1/1990 | Stahlecker | 384/549 |

*Primary Examiner*—Thomas R. Hannon
*Attorney, Agent, or Firm*—Kenyon & Kenyon

[57] ABSTRACT

A supporting disk for the rotor of an open-end spinning machine, comprising a hub ring of metallic material and a support ring made of elastomer polyurethane that is affixed to the outer surface of the hub ring, whereby the support ring is affixed to the outer surface of an auxiliary ring consisting of polymer material. The material of the auxiliary ring has a modulus of elasticity of 7000 to 13,000 N/mm$^2$, a dimensional stability under heat from 150° to 250° C., as well as an elongation at break of 1.3 to 3%. It is affixed with radial widening of its inside diameter and with an interference fit to the outer surface of the hub ring.

22 Claims, 3 Drawing Sheets

SUPPORTING DISK

BACKGROUND OF THE INVENTION

The present invention relates to a supporting disk for the flywheel of an open-end spinning machine.

Such supporting disks are known and are used as a mounting support for the flywheel of an open end spinning machine. Such supporting disks typically include an aluminum hub ring having an outer surface area onto which a support ring made of elastomer polyurethane is directly premolded. However, supporting disks subjected to wear are usually replaced by an entirely new disk even when only the support ring is worn.

The object of the present invention is to provide a supporting disk in which the support ring may be replaced independently of the hub ring and which also has an excellent rotational symmetry.

SUMMARY OF THE INVENTION

This objective is solved by providing a supporting disk for the flywheel of an open-end spinning machine having a hub a ring, an auxiliary ring, and a support ring. The auxiliary ring is made of a polymer material with a modulus of elasticity of 7000 to 13,000 N/mm$^2$, a dimensional stability under heat from 150° to 250° C., and an elongation at break of 1.3 to 3%, and has a radial projection in its inner circumferential surface fitting the outer circumferential surface of the hub ring. The support ring is made of elastomer material and is affixed to the outer circumferential surface of the auxiliary ring. The auxiliary ring has an I-shaped profile and the support ring has a U-shaped profile. The inner surface of the U-shaped profile has lateral sides which project radially inward such that the inner surface of the U-shaped profile of the support disk mates with both sides of the outer surface of the I-shaped profile of the auxiliary ring. The I-shaped profile of said auxiliary ring includes perforations that are uniformly distributed in the circumferential direction such that said lateral sides of said U-shaped profile of the support ring are joined via the perforations.

In a preferred embodiment, the auxiliary ring is made of polyurea. In a preferred embodiment, the hub ring includes a groove at its outer circumferential surface and the auxiliary ring includes a retaining claw provided in the area of the inner circumference of the auxiliary ring such that said auxiliary ring is movable in the radial direction until said retaining claw snaps into the groove of the tub ring.

In a preferred embodiment, the retaining claw is formed on a segment which encircles the hub ring over its entire circumference.

In an alternate embodiment, the auxiliary ring is perforated by radially extending cut-outs uniformly distributed about the circumference of the auxiliary ring and includes depressions in its inner peripheral area adjacent to the cut-outs wherein the support ring includes projections penetrating the cut-outs and extending into a radial intermediate zone between the auxiliary ring and the hub ring. The projections project beyond the inner peripheral area of the auxiliary ring.

In a preferred embodiment of the alternate embodiment, the projections include a radially innermost boundary surface extending essentially parallel to the axis of rotation. The axial length of the inner boundary surface of the projections preferably essentially conforms with the axial width of the auxiliary ring.

In a preferred embodiment, the auxiliary ring includes a void extending from a side surface of the auxiliary ring in a direction essentially parallel with the axial direction of the disk and defining a radially inner portion of the auxiliary ring and a radially outer portion of the auxiliary ring. The radially inner portion of the auxiliary ring accommodates the retaining claw wherein upon application of a force, the radially inner portion of the auxiliary ring and the radially outer portion of the auxiliary ring may be brought closer thereby decreasing a width of the void by an amount at least as great as the height of the retaining claw.

In the supporting disk of the present invention, the support ring may be affixed to the outer surface of an auxiliary ring. The auxiliary ring consists essentially of a polymer material with a modulus of elasticity of 7000 to 13,000 N/mm$^2$, a dimensional stability under heat from 150° to 250° C., as well as an elongation at break of 1.3 to 3%. Lastly, the auxiliary ring may be affixed with radial widening of its inside diameter and with an interference fit to the outer surface of the hub ring.

The support ring and the hub ring of the present invention form a unit which is inseparable even under severe operating conditions. This unit can be produced easily and cost-effectively on a commerical scale and is well suited for meeting the above-required conditions. The hub ring of the unit is distinguished by excellent dimensional stability. This dimensional stability permits the support ring to remain reliably secured to the outer surface of the hub ring even after extended periods of operation. Secondary or auxiliary devices are not needed. The unit is simply pressed axially onto the hub ring. Since the auxiliary ring is made of polymer material, hub ring damage does not occur, even when an aluminum hub ring is used. After the support ring begins to wear, separating it from the hub ring may be desired. Such a separation is possible by pushing the unit axially off the hub ring.

A support ring manufactured from elastomer polyurethane demonstrates a particularly good resistance to abrasion, in conjunction with desirable damping properties. Thus, an excellent service life is attained.

The support ring of the present invention includes an auxiliary ring. The auxiliary ring can have an I-shaped profile, and the support ring can have a U-shaped profile in the area of its inner, radial boundary edge, whereby the profile of the support ring mates with the auxiliary ring on both sides with lateral sides that project radially inward. As a result, the contact surface between the auxiliary ring and the support ring is enlarged which considerably improves the adhesion between the two rings. By this means, dimensional changes in the support ring caused by centrifugal force are effectively countered.

Providing uniformly distributed perforations in the circumferential direction of the I-shaped profile of the auxiliary ring and forming the lateral sides of the profile of the support ring such that they enter into one another in one piece via the perforations is advantageous since this configuration secures the auxiliary ring and the support ring to one another with a positive fit. Therefore, any mutual separation, even under unfavorable operating conditions, is virtually eliminated.

Manufacturing the hub-ring from polyurea has proven to be favorable. Not only does a polyurea hub ring have a modulus of elasticity of 7000 to 13,000

N/mm$^2$, a dimensional stability under heat from 150° to 250° C., and an elongation at break of 1.3 to 3%, but it also provides a good adhesive base for the elastomer polyurethane such that costly preparatory treatment may be avoided. Avoiding such costly preparatory treatment permits the supporting disk of the present invention to be manufactured much more economically than known support disks.

Providing the area of the inner circumference of the auxiliary ring with at least one retaining claw that is movable in the radial direction and able to be snapped into a groove of the hub ring open radially to the outside clearly improves the reliability with which the auxiliary ring is localized and pressed axially onto the hub ring.

Configuring the retaining claw on a segment of the profile of the auxiliary ring that projects in the axial direction is advantageous. This auxiliary ring encircles the hub ring over its entire circumference thereby preventing the notching arrangement of the retaining claw in the groove from becoming undone because of centrifugal force, suppressing disturbances in the rotational symmetry of the auxiliary ring, and avoiding manifestations of imbalance.

In an alternate embodiment, the auxiliary ring has an essentially rectangularly enclosed profile in the area of its inner circumference and the segment bearing the retaining claw may be configured within the axial extent of the profile so that it is separated from the radially outward lying parts of the profile merely by a groove that mates axially with the profile. In such an embodiment, the axial overall length of the auxiliary ring can correspond to known models so that known supporting disks may be replaced with those according to the present invention. Furthermore, dimensioning the groove to have such a small radial width that a sufficient spring deflection of the retaining claw is just barely guaranteed when it is pressed axially on to the hub ring so that a detaining effect results with respect to continuing spring deflections is preferable. In this manner, any damage to the segment caused by centrifugal force is able to be effectively countered.

In the area of its inner circumference, the auxiliary ring can be radially perforated by cut-outs that are uniformly distributed in the circumferential direction whereby the cut-outs are penetrated by projections of the support ring. The projections extend into a radial intermediate zone between the auxiliary ring and the hub ring whereby, conditional upon their manufacture, the projections project beyond the inner peripheral area of the auxiliary ring in the radial direction to the inside and contact the hub ring with supporting surfaces. Further, in the area of the supporting surfaces, spaces for rebound travel adjoin the projections in the circumferential direction. In this case, the hub ring is alternately contacted first of all by components of the auxiliary ring and by the supporting surface of the projections of the support ring at uniform circumferential distances. In addition to providing a good rotational symmetry of the ready-to-use supporting disk, this guarantees an anti-rotation localization of the unit comprising the auxiliary ring and the support ring on the hub ring.

The supporting surface should extend essentially parallel to the axis of rotation and, to the extent that is possible, have one length which essentially conforms with that of the auxiliary ring. In this manner, undesirable deformations arising in long-term use are countered and a good rotational symmetry is guaranteed.

To connect the hub ring and an applied drive shaft, the generally known shaft/hub connections can be provided, such as keyed connections or polygon-shaped shaft/hub connections.

DETAILED DESCRIPTION

The term "elongation at break" is the linear deformation of a test object at any time relative to the original measured length of the test specimen (DIN 53455).

The term "modulus of elasticity" is the correlation between strain and elongation in the case of a bar expansion, given an unimpeded reduction in cross-section (DIN 53457).

The term "dimensional stability under heat" is the ability of a test specimen to substantially retain its form up to a certain temperature while subjected to a specific stationary load (DIN 53461).

Figure 1:
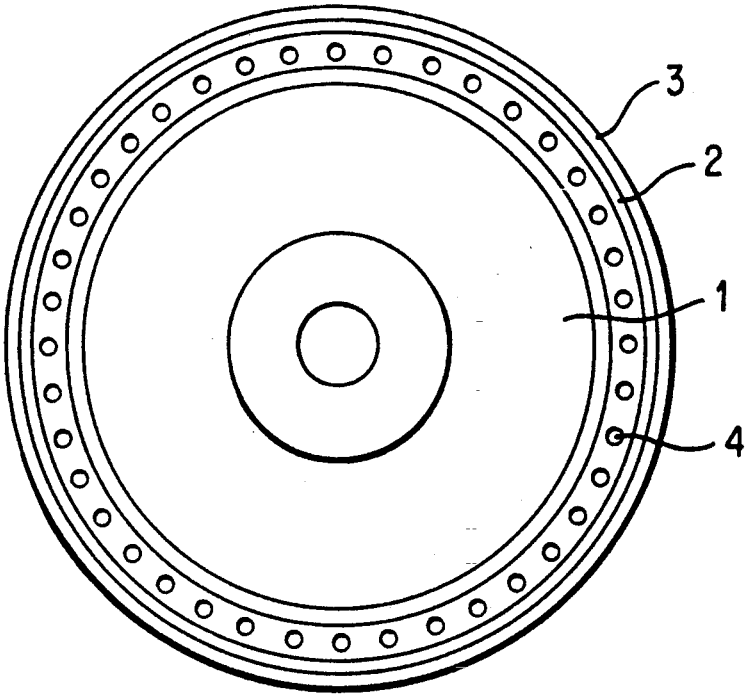
FIG. 1 is a front view, in a partially intersected representation of a supporting disk according to the present invention.
Figure 2:
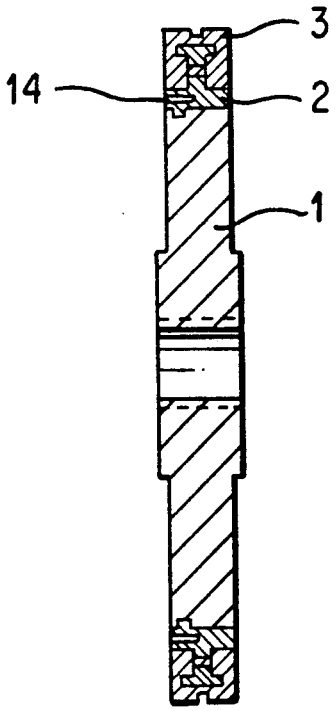
FIG. 2 is a cross sectional view passing through the center of the supporting disk of FIG. 1.

The supporting disk shown in FIG. 1 is intended to be used as the flywheel of an open-end spinning machine, which can attain rotational speeds of 130,000 rpm.

The supporting disk includes a hub ring 1, preferably aluminum, which has a dynamically balanced shape and which has an outer cylindrical surface. The outer cylindrical surface is interrupted only by a groove 6 which is configured in the area of the one end face.

An auxiliary ring 2 is located on the periphery of the hub ring 1. The auxiliary ring 2 may consist essentially of polyurea for example and has a modulus of elasticity of 10,000 N/mm$^2$, a dimensional stability under heat of 200° C., and an elongation at break of 2.5%. The auxiliary disk 2 is immovably affixed to the hub ring 1 through the flexible expansion of its inner circumference.

Figure 3:
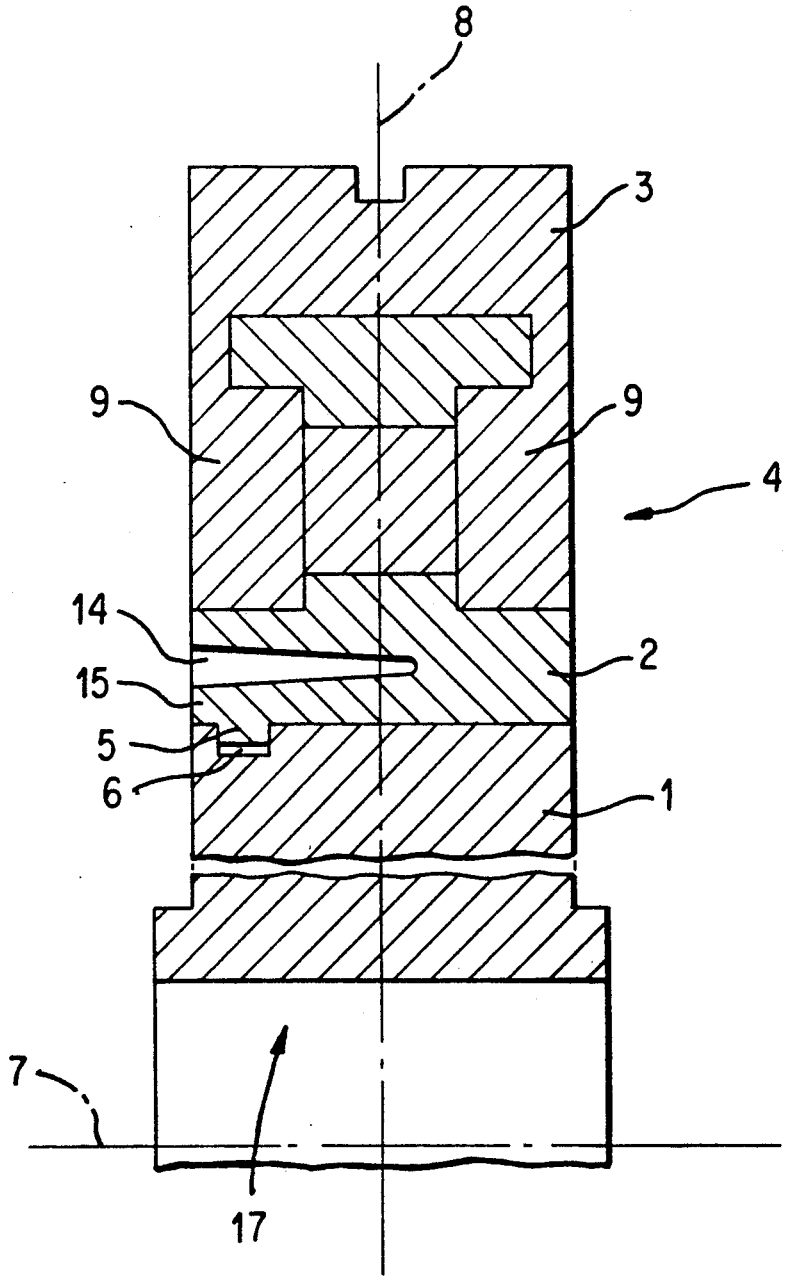
FIG. 3 is an enlarged representation of a cut-away portion of the supporting disk according to FIG. 2.
Figure 4:
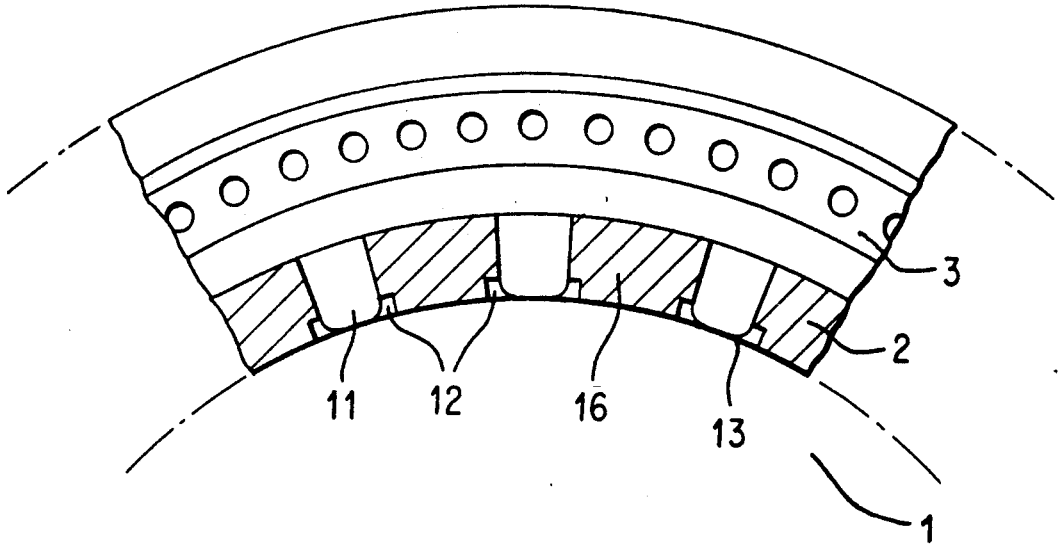
FIG. 4 is a front view of a segmental cut-away portion of an alternative specific embodiment of a supporting disk.

The auxiliary ring 2 has an essentially I-shaped profile, which is allocated essentially perpendicular to the axis of rotation of the supporting disk. The auxiliary ring 2 is penetrated in the middle area of its radial extent by bore holes 4 that are uniformly distributed in the circumferential direction (FIGS. 1, 3, and 4).

On the radial, inner side, the auxiliary ring 2 has an essentially rectangularly defined profile, into which a circumferential groove 14 penetrates in the axial direction from one of the side faces. A segment 15 of the auxiliary ring 2 that projects in the axial direction is provided radially inside the groove 14 and includes a circumferential retaining claw 5. During normal operational use, the retaining claw 5 is locked into place in the groove 6 of the hub ring 1. This guarantees that the auxiliary ring 2 is secured to the hub ring 1 and prevents the auxiliary ring 2 from wobbling on the outer surface of the hub ring 1.

To localize the auxiliary ring 2 on the hub ring 1, the segment 15 is pressed against a spring deflection, into the area of the circumferential groove 14 and the auxiliary ring 2 is slid in the axial direction, on to the outer circumference of the hub ring 1 until the potential stored in the spring deflection is able to be released thereby locking the retaining claw 5 into place in the groove 6. The subsequent separation of the auxiliary ring 2 from the hub ring 1 is easily performed with the help of a simple press tool. The inside surface 17 of the hub ring 1 is shaped in a way that guarantees a secure shaft/hub connection with a drive shaft (not shown).

The support ring 3 may consist essentially of elastomer polyurethane for example and is premolded directly on the auxiliary ring 2. It has an essentially U-shaped profile which mates with the I-shaped profile of the outer surface of the auxiliary ring 2 with lateral sides 9 that project radially inward. Each of the lateral sides 9 penetrate the bore hole 4 of the auxiliary ring 2 so that they blend into one another. As a result, the support ring 3 is affixed to the auxiliary ring 2 by the penetration of the profiles (see FIG. 3) in addition to its adhesive attachment to the auxiliary ring 2. As a result, even at the highest rotational speeds and the associated centrifugal force, the support ring 3 will not become detached from the auxiliary ring 2.

FIG. 4 illustrates an alternate embodiment of the present invention, in which the auxiliary ring 2 is perforated by radial cut-outs that are uniformly distributed in the circumferential direction. The cut-outs are penetrated by projections 11 of the support ring 3. The projections 11 extend into a radial intermediate zone between the auxiliary ring 2 and the hub ring wherein, conditional upon their manufacture, the projections 11 project radially inward beyond the inner peripheral area of the auxiliary ring 2. The projections 11 contact the hub ring 1 at a supporting surface 13. In the area of the supporting surfaces 13, spaces 12 for rebound travel adjoin the projections in the circumferential direction. In this case, the hub ring 1 is alternately contacted by components of the auxiliary ring 2 and of the support ring 3 at uniform circumferential distances. As a result, a good dynamically balanced localization of the auxiliary ring and the support ring 2, 3 on the hub ring 1 is provided which affords an anti-rotation anchoring of both units to one another.

What is claimed is:

1. A supporting disk for the flywheel of an open-end spinning machine comprising:

a) a hub ring, said hub ring having an outer circumferential surface;

b) an auxiliary ring, said auxiliary ring i) having an outer and an inner circumferential surface, ii) being made of a polymer material with a modulus of elasticity of 7000 to 13,000 N/mm$^2$, a dimensional stability under heat from 150° to 250° C., and an elongation at break of 1.3 to 3%, and iii) having a radial projection in its inner circumferential surface said radial projection fitting said outer circumferential surface of said hub ring; and c) a support ring, said support ring i) being made of elastomer material, and ii) being affixed to said outer circumferential surface of said auxiliary ring.

2. The supporting disk according to claim 1 wherein said auxiliary ring has and I-shaped profile and said support ring has a U-shaped profile, the inner surface of the U-shaped profile having lateral sides which project radially inward such that the inner surface of the U-shaped profile of the support disk mates with both sides of the outer surface of the I-shaped profile of the auxiliary ring.

3. The supporting disk according to claim 2 wherein said auxiliary ring is made of polyurea.

4. The supporting disk according to claim 3 wherein said hub ring includes a groove at its outer circumferential surface and wherein said auxiliary ring includes a retaining claw, said retaining claw being provided in the area of the inner circumference of the auxiliary ring such that said auxiliary ring is movable in the radial direction until said retaining claw snaps into said groove of said hub ring.

5. The supporting disk according to claim 4, wherein said the retaining claw is formed on a segment which encircles the hub ring over its entire circumference.

6. The supporting disk according to claim 2 wherein said hub ring includes a groove at its outer circumferential surface and wherein said auxiliary ring includes a retaining claw, said retaining claw being provided in the area of the inner circumference of the auxiliary ring such that said auxiliary ring is movable in the radial direction until said retaining claw snaps into said groove of said hub ring.

7. The supporting disk according to claim 6, wherein said the retaining claw is formed on a segment which encircles the hub ring over its entire circumference.

8. The supporting disk according to claim 2 wherein said I-shaped profile of said auxiliary ring includes perforations that are uniformly distributed in the circumferential direction such that said lateral sides of said U-shaped profile of said support ring are joined via said perforations.

9. The supporting disk according to claim 8 wherein said auxiliary ring is made of polyurea.

10. The supporting disk according to claim 9 wherein said hub ring includes a groove at its outer circumferential surface and wherein said auxiliary ring includes a retaining claw, said retaining claw being provided in the area of the inner circumference of the auxiliary ring such said auxiliary ring is movable in the radial direction until said retaining claw snaps into said groove of said hub ring.

11. The supporting disk according to claim 10, wherein said the retaining claw is formed on a segment which encircles the hub ring over its entire circumference.

12. The supporting disk according to claim 8 wherein said hub ring includes a groove at its outer circumferential surface and wherein said auxiliary ring includes a retaining claw, said retaining claw being provided in the area of the inner circumference of the auxiliary ring such that said auxiliary ring is movable in the radial direction until said retaining claw snaps into said groove of said hub ring.

13. The supporting disk according to claim 12, wherein said the retaining claw is formed on a segment which encircles the hub ring over its entire circumference.

14. The supporting disk according to claim 1 wherein said auxiliary ring is made of polyurea.

15. The supporting disk according to claim 14 wherein said hub ring includes a groove at its outer circumferential surface and wherein said auxiliary ring includes a retaining claw, said retaining claw being provided in the area of the inner circumference of the auxiliary ring such that said auxiliary ring is movable in the radial direction until said retaining claw snaps into said groove of said hub ring.

16. The supporting disk according to claim 15, wherein said the retaining claw is formed on a segment which encircles the hub ring over its entire circumference.

17. The supporting disk according to claim 1 wherein said hub ring includes a groove at its outer circumferential surface and wherein said auxiliary ring includes a retaining claw, said retaining claw being provided in the area of the inner circumference of the auxiliary ring such that said auxiliary ring is movable in the radial direction until said retaining claw snaps into said groove of said hub ring.

18. The supporting disk according to claim 17, wherein said the retaining claw is formed on a segment which encircles the hub ring over its entire circumference.

19. The supporting disk according to claim 17 wherein said auxiliary ring includes a void, sing void i) extending from a side surface of said auxiliary ring in a direction essentially parallel with the axial direction of the disk, and ii) defining a radially inner portion of the auxiliary ring and a radially outer portion of the auxiliary ring, said radially inner portion of said auxiliary ring accommodating said retaining claw, wherein upon application of a force, the radially inner portion of the auxiliary ring and the radially outer portion of the auxiliary ring may be brought closer thereby decreasing a width of said void by an amount at least as great as the height of the retaining claw.

20. The supporting disk according to claim 1 wherein said auxiliary ring is perforated by radially extending cut-outs, said cut outs being uniformly distributed about the circumference of the auxiliary ring and including depressions in the inner peripheral area of the auxiliary ring adjacent to said cut-outs, and wherein said support ring includes projections, said projections penetrating said cut-outs and extending into a radial intermediate zone between the auxiliary ring and the hub ring, said projections projecting beyond the inner peripheral area of the auxiliary ring.

21. The supporting disk according to claim 20, wherein said projections include a radially innermost boundary surface, said boundary surface extending essentially parallel to this axis of rotation.

22. The supporting disk according to claim 21, wherein the axial length of the inner boundary surface of the projections essentially conforms with the axial width of the auxiliary ring.

* * * * *